US012716206B1

(12) United States Patent
Iverson et al.

(10) Patent No.: US 12,716,206 B1
(45) Date of Patent: Aug. 25, 2026

(54) SYSTEM AND METHOD FOR IMPROVING VISIBILITY AROUND COMPACTOR

(71) Applicant: Caterpillar Paving Products Inc., Brooklyn Park, MN (US)

(72) Inventors: Robert Kenneth Iverson, Maple Grove, MN (US); Francisco Romero Ruiz, Madrid (ES)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 19/183,968

(22) Filed: Apr. 21, 2025

(51) Int. Cl.
*E02F 9/26* (2006.01)
*E01C 19/22* (2006.01)

(52) U.S. Cl.
CPC ..... *E02F 9/261* (2013.01); *E01C 19/22* (2013.01); *E01C 2301/30* (2013.01)

(58) Field of Classification Search
CPC ..... E01C 19/002; E01C 19/22; E01C 19/26; E01C 19/231; E01C 2301/30; E02F 9/261; H04N 7/18; H04N 7/181
USPC ..... 348/143, 148; 701/50, 65; 404/117; 382/103, 108
See application file for complete search history.

(56) References Cited

U.S. PATENT DOCUMENTS 9,871,968 B2 1/2018 Husted et al.
10,781,572 B2 9/2020 Machida et al.
11,541,827 B2 1/2023 Lee et al.
2021/0010244 A1* 1/2021 Ito ..... E02F 9/262
2022/0120907 A1 4/2022 Impola et al.
2022/0220705 A1 7/2022 Lee
2022/0329731 A1 10/2022 Park et al.
2023/0035181 A1 2/2023 Lee et al.

OTHER PUBLICATIONS

Develon (Doosan), Doosan Launches Industry First Wheel Loader Transparent Bucket System Enabling to See Blind Spots, Oct. 5, 2022, 5, Newsroom of heavyquip magazine.

* cited by examiner

*Primary Examiner* — Sherrie Hsia

(57) ABSTRACT

A system for improving visibility around a compactor includes imaging devices to generate an input image that includes a surrounding area of the compactor and one or more components of the compactor. The system also includes a controller to receive, from the imaging devices, one or more input images, analyze the input images to determine a position of the components of the compactor within the input images, process the input images to simulate the components of the compactor as transparent, and generate an output image that includes the surrounding area of the compactor and the components of the compactor. The components of the compactor are depicted as transparent in the output image. The system includes a display module that receives and displays the output image to indicate, to the operator, a position of at least one obstacle and/or a previously compacted region.

20 Claims, 5 Drawing Sheets

SYSTEM AND METHOD FOR IMPROVING VISIBILITY AROUND COMPACTOR

TECHNICAL FIELD

The present disclosure relates to a compactor, a system for improving visibility around the compactor, and a method for improving visibility around the compactor.

BACKGROUND

A compactor is typically used for compacting materials like asphalt, soil, and/or other materials. The compactor includes a drum that contacts the materials to be compacted. Visibility around the compactor is key to perform work operations in an efficient manner and to be aware of a presence of various obstacles around the component. While the operator is seated within an operator cabin of the compactor, components of the compactor may block an operator's visibility of an area surrounding the compactor, including the obstacles. While performing work operations, it may be challenging for the operator to understand a position of the components, such as, the drum of the compactor relative to obstacles or relative to compacted/uncompacted regions at a worksite.

U.S. Patent Application 2023/0035181 describes a control system for construction machinery includes an upper camera installed in a driver cabin of a rear vehicle body to photograph the front of the driver cabin, a lower camera installed in a front vehicle body rotatably connected to the rear vehicle body to photograph the front of the front vehicle body, an angle information detection portion configured to detect information on a refraction angle of the front vehicle body with respect to the rear vehicle body, an image processing device configured to synthesize first and second images captured from the upper and lower cameras, and configured to determine a position of a transparency processing area in the synthesized image according to the refraction angle information and transparency-process at least one of the first and second images in the transparency processing area, and a display module configured to display the synthesized image transparency-processed by the image processing device.

SUMMARY

In an aspect of the present disclosure, a system for improving visibility around a compactor is provided. The system includes a plurality of imaging devices coupled to the compactor. Each of the plurality of imaging devices is configured to generate an input image. The input image includes a surrounding area of the compactor and one or more components of the compactor. One or more of the input images generated by one or more of the plurality of imaging devices includes at least one obstacle present in the surrounding area of the compactor and/or a previously compacted region compacted by the compactor. The system also includes a controller communicably coupled with the plurality of imaging devices. The controller is configured to receive, from one or more of the plurality of imaging devices, one or more input images. The controller is also configured to analyze the one or more input images to determine a position of the one or more components of the compactor within the one or more input images. The controller is further configured to process the one or more input images to simulate the one or more components of the compactor as transparent. The controller is configured to generate an output image. The output image includes the surrounding area of the compactor and the one or more components of the compactor. The one or more components of the compactor are depicted as transparent in the output image. The output image includes the at least one obstacle and/or the previously compacted region. The system further includes a display module configured to receive the output image from the controller. The display module is configured to display the output image thereon to provide a visual indication of the surrounding area of the compactor to an operator of the compactor. The output image at least indicates, to the operator, a position of the at least one obstacle and/or the previously compacted region in relation to the compactor.

In another aspect of the present disclosure, a compactor is provided. The compactor includes a frame. The compactor also includes a drum coupled to the frame. The compactor further includes a system for improving visibility around a compactor. The system includes a plurality of imaging devices coupled to the compactor. Each of the plurality of imaging devices is configured to generate an input image. The input image includes a surrounding area of the compactor and one or more components of the compactor. One or more of the input images generated by one or more of the plurality of imaging devices includes at least one obstacle present in the surrounding area of the compactor and/or a previously compacted region compacted by the compactor. The system also includes a controller communicably coupled with the plurality of imaging devices. The controller is configured to receive, from one or more of the plurality of imaging devices, one or more input images. The controller is also configured to analyze the one or more input images to determine a position of the one or more components of the compactor within the one or more input images. The controller is further configured to process the one or more input images to simulate the one or more components of the compactor as transparent. The controller is configured to generate an output image. The output image includes the surrounding area of the compactor and the one or more components of the compactor. The one or more components of the compactor are depicted as transparent in the output image. The output image includes the at least one obstacle and/or the previously compacted region. The system further includes a display module configured to receive the output image from the controller. The display module is configured to display the output image thereon to provide a visual indication of the surrounding area of the compactor to an operator of the compactor. The output image at least indicates, to the operator, a position of the at least one obstacle and/or the previously compacted region in relation to the compactor.

In yet another aspect of the present disclosure, a method for improving visibility around a compactor is provided. The method includes generating, by one or more of a plurality of imaging devices coupled to the compactor, one or more input images. Each input image includes a surrounding area of the compactor and one or more components of the compactor. One or more of the input images generated by one or more of the plurality of imaging devices includes at least one obstacle present in the surrounding area of the compactor and/or a previously compacted region compacted by the compactor. The method also includes receiving, by a controller, one or more input images from one or more of the plurality of imaging devices. The plurality of imaging devices are communicably coupled with the controller. The method further includes analyzing, by the controller, the one or more input images to determine a position of one or more components of the compactor within the one or more input images. The method includes processing, by the controller, the one or more input images to simulate the one or more components of the compactor as transparent. The method also includes generating, by the controller, an output image. The output image includes the surrounding area of the compactor and the one or more components of the compactor. The one or more components of the compactor are depicted as transparent in the output image. The output image includes the at least one obstacle and/or the previously compacted region. The method further includes receiving, by a display module, the output image from the controller. The display module is communicably coupled with the controller. The method includes displaying, via the display module, the output image to provide a visual indication of the surrounding area of the compactor to an operator of the compactor. The method also includes indicating, to the operator, a position of the at least one obstacle and/or the previously compacted region in relation to the compactor.

Other features and aspects of this disclosure will be apparent from the following description and the accompanying drawings.

DETAILED DESCRIPTION

Wherever possible, the same reference numbers will be used throughout the drawings to refer to the same or like parts.

Figure 1:
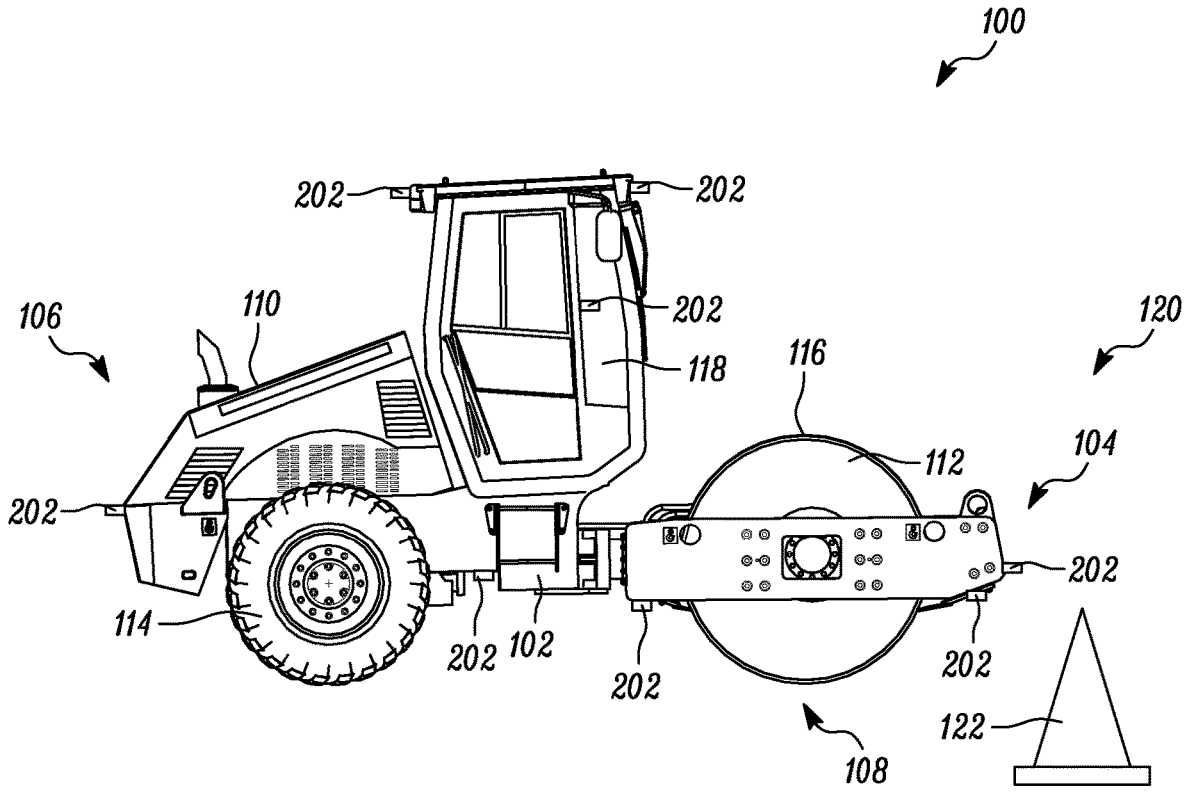
FIG. 1 is a schematic view of an exemplary compactor, according to an example of the present disclosure.

FIG. 1 is a schematic side view of an exemplary compactor 100. The compactor 100 may be embodied as a soil compactor, a landfill compactor, an asphalt compactor, a pneumatic roller, a tandem vibratory roller, and the like. Further, the disclosure is not limited to the compactor 100 and may include any other machine. The compactor 100 includes a frame 102. The compactor 100 defines a front end 104, a rear end 106 opposite the front end 104, and sides 108 (only one of which is illustrated herein). The frame 102 supports various parts of the compactor 100 thereon. The frame 102 defines an enclosure 110 proximate to the rear end 106. The compactor 100 also includes a power source (not shown) disposed within the enclosure 110. Various components of the compactor 100 are operated by the power source. The power source may be an engine, such as, an internal combustion engine, a fuel cell, a battery system, without any limitations.

The compactor 100 further includes a drum 112 coupled to the frame 102. The drum 112 is disposed proximal to the front end 104 of the compactor 100. The compactor 100 includes a pair of wheels 114 disposed at the rear end 106 of the compactor 100. The drum 112 and the wheels 114 support the frame 102 of the compactor 100 and allow the compactor 100 to travel over ground surfaces. Further, the drum 112 contacts a work surface to perform a compaction operation for compacting materials, such as, asphalt, soil, gravel, and the like. In some examples, the drum 112 may include a pad-foot type drum having a number of segmented pads disposed on the drum 112 to allow the compactor 100 to perform compaction operations. The drum 112 includes an outer shell 116. The outer shell 116 contacts various surfaces during compaction operations or during mobility of the compactor 100. In other examples, the compactor 100 may include two drums instead of the single drum 112 and may omit the wheels 114. The compactor 100 includes an operator cabin 118. An operator may be seated within the operator cabin 118 to perform and/or observe compaction operations.

Figure 2:
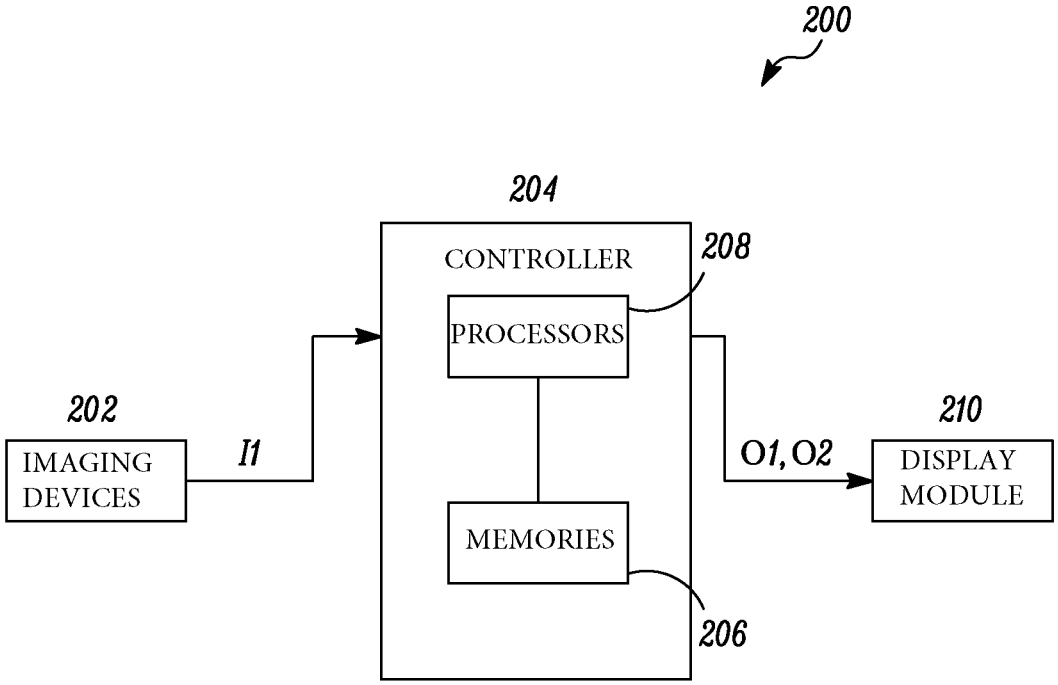
FIG. 2 is a block diagram of a system for improving visibility around the compactor of FIG. 1, according to an embodiment of the present disclosure.

Referring to FIGS. 1 and 2, the present disclosure relates to a system 200 for improving visibility around the compactor 100 is provided. The system 200 includes a number of imaging devices 202 coupled to the compactor 100. Each of the number of imaging devices 202 generates an input image I1. The input image I1 includes a surrounding area 120 of the compactor 100 and one or more components 112, 102, 118, 114 of the compactor 100. The one or more components 112, 102, 118, 114 of the compactor 100 includes the drum 112 of the compactor 100, the frame 102 of the compactor 100, portions of the operator cabin 118 of the compactor 100, and/or the one or more wheels 114 of the compactor 100. Further, one or more of the input images I1 generated by one or more of the number of imaging devices 202 includes one or more obstacles 122 (only one is shown in FIG. 1) present in the surrounding area 120 of the compactor 100 and/or a previously compacted region 124 (shown in FIG. 4) compacted by the compactor 100. The term "previously compacted region" refers to an area that was previously compacted by the compactor 100.

The imaging devices 202 may be coupled to the compactor 100 at the front end 104, the rear end 106, and at one or more sides 108 of the compactor 100. Accordingly, at least some of the number of imaging devices 202 generate one or more input images I1 of the surrounding area 120 at the front end 104 of the compactor 100. Further, at least some of the number of imaging devices 202 generate one or more input images I1 of the surrounding area 120 at the rear end 106 of the compactor 100. Moreover, at least some of the number of imaging devices 202 generate one or more input images I1 of the surrounding area 120 at one or more sides 108 of the compactor 100.

The imaging devices 202 may include a monochrome digital camera, a high-resolution digital camera, or any suitable digital camera. Further, the imaging devices 202 may include any one of a still camera, a camcorder, a video camera, a closed-circuit television (CCTV) camera, and the like, without any limitations. The imaging devices 202 may include one or more optical flow chips and/or other devices that facilitate acquisition of images. In some examples, the imaging devices 202 may embody a complimentary metal-oxide semiconductor (CMOS) camera. It should be noted that the imaging devices 202 may include any other type of imaging device known in the art.

Referring now to FIG. 2, the system 200 also includes a controller 204 communicably coupled with the number of imaging devices 202. The controller 204 includes one or more memories 206. The memories 206 may include any means of storing information, including a hard disk, an optical disk, a floppy disk, ROM (read only memory), RAM (random access memory), PROM (programmable ROM), EEPROM (electrically erasable PROM), or other computer-readable memory media known to persons skilled in the art.

The controller 204 also includes one or more processors 208 communicably coupled to the one or more memories 206. It should be noted that the one or more processors 208 may embody a single microprocessor or multiple microprocessors for receiving various input signals and generating output signals. Numerous commercially available microprocessors may perform the functions of the one or more processors 208. Each processor 208 may further include a general processor, a central processing unit, an application specific integrated circuit (ASIC), a digital signal processor, a field programmable gate array (FPGA), a digital circuit, an analog circuit, a microcontroller, any other type of processor, or any combination thereof. Each processor 208 may include one or more devices that may be operable to execute computer executable instructions or computer code that may be stored and retrieved from the one or more memories 206.

The controller 204 receives, from one or more of the number of imaging devices 202, one or more input images I1. The controller 204 analyzes the one or more input images I1 to determine a position of the one or more components 112, 102, 118, 114 (see FIG. 1) of the compactor 100 (see FIG. 1) within the one or more input images I1. In some examples, the controller 204 receives a number of coordinates of the one or more components 112, 102, 118, 114 of the compactor 100 to determine the position of the one or more components 112, 102, 118, 114 of the compactor 100 within the one or more input images I1.

The controller 204 processes the one or more input images I1 to simulate the one or more components 112, 102, 118, 114 of the compactor 100 as transparent. The controller 204 generates an output image O1, O2. The output image O1, O2 includes the surrounding area 120 (see FIG. 1) of the compactor 100 and the one or more components 112, 102, 118, 114 of the compactor 100. The one or more components 112, 102, 118, 114 of the compactor 100 are depicted as transparent in the output image O1, O2. The output image O1, O2 further includes the one or more obstacles 122 (see FIG. 1) and/or the previously compacted region 124 (see FIG. 4).

Figure 3:
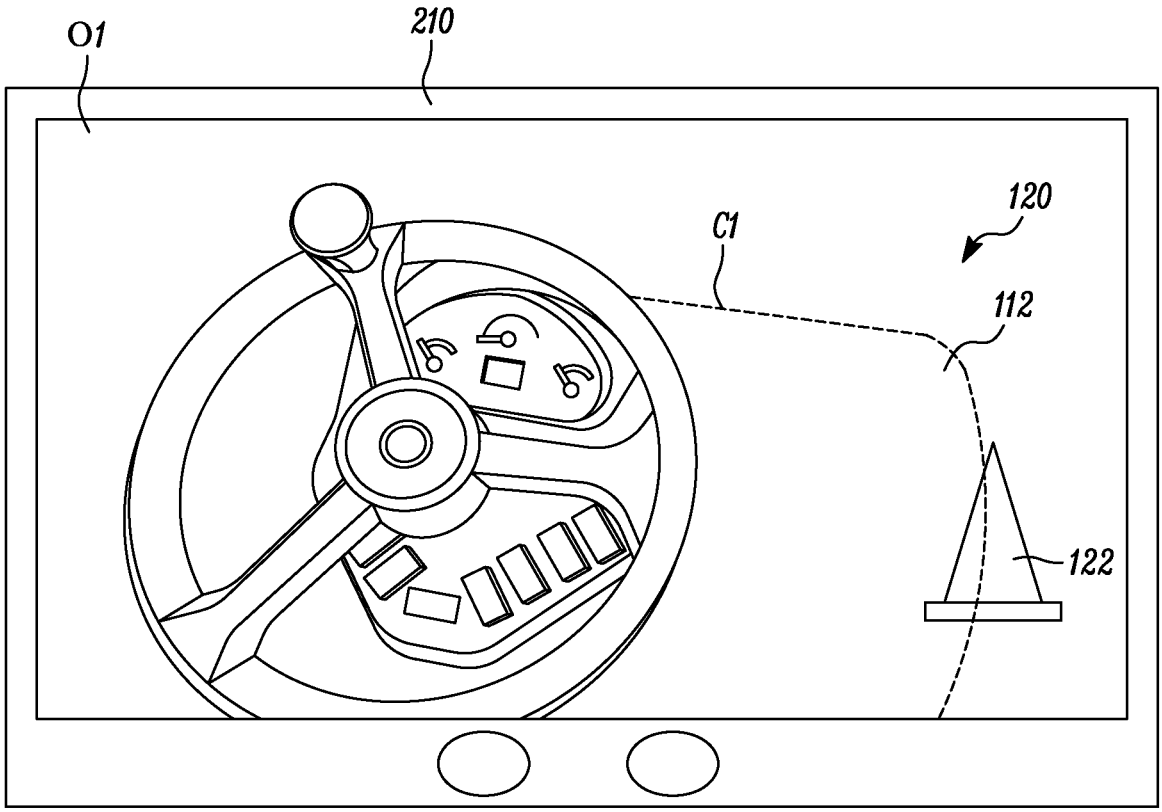
FIG. 3 is an exemplary illustration of an output image generated on a display module of the system of FIG. 2, according to an example of the present disclosure.
Figure 4:
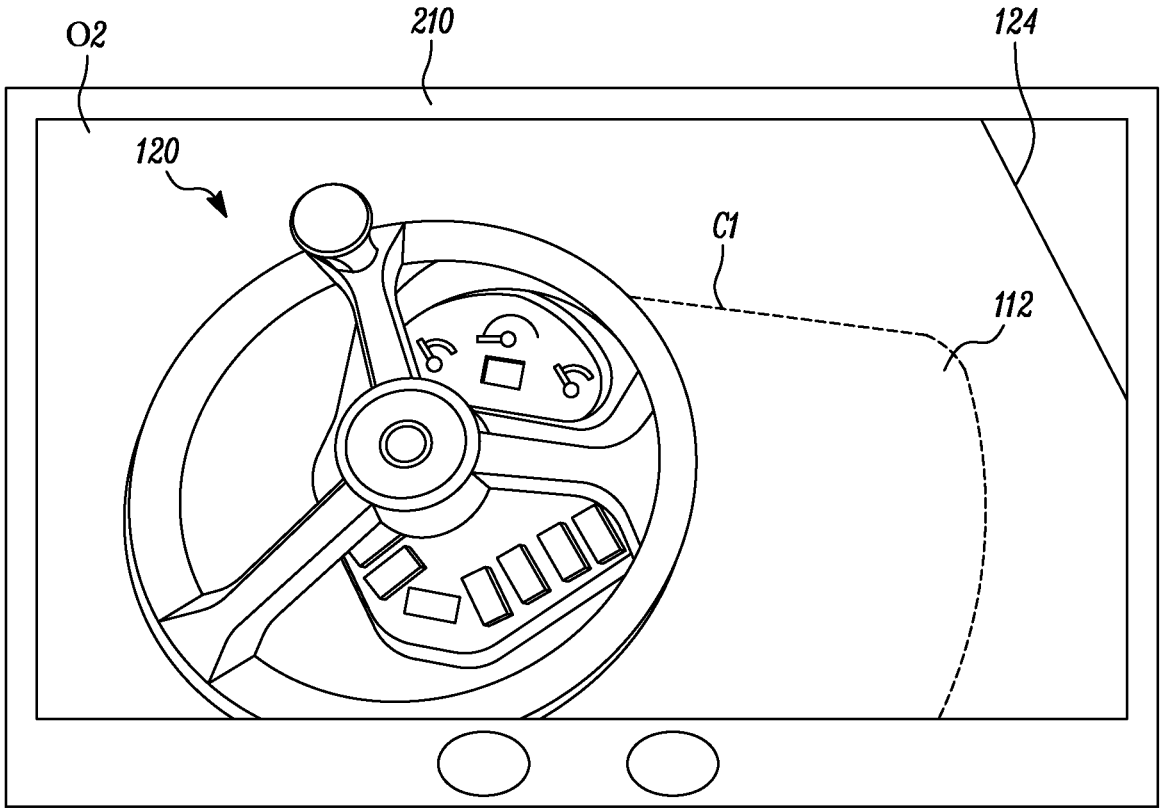
FIG. 4 is an exemplary illustration of an output image generated on the display module of the system of FIG. 2, according to another example of the present disclosure.

Referring to FIGS. 2, 3, and 4, the system 200 further includes a display module 210. The display module 210 is disposed within the operator cabin 118 (see FIG. 1) of the compactor 100 (see FIG. 1). The display module 210 may be any type of device that can display information, videos, or images thereon, and may include, for example, a handheld device, a smartphone, a tablet, and the like. The display module 210 receives the output image O1, O2 from the controller 204. The display module 210 displays the output image O1, O2 thereon to provide a visual indication of the surrounding area 120 of the compactor 100 to the operator of the compactor 100. Moreover, the output image O1, O2 at least indicates, to the operator, a position of the one or more obstacles 122 and/or the previously compacted region 124 in relation to the compactor 100.

A contour of each of the one or more components 112, 102, 118, 114 (see FIG. 1) of the compactor 100 is illustrated as a dotted line on the output image O1, O2. As shown in FIGS. 3 and 4, a contour C1 of the drum 112 is illustrated as a dotted line on the output image O1, O2. Although just the drum 112 is illustrated in FIGS. 3 and 4, any other component of the compactor 100 (see FIG. 1) may be shown as transparent on the output image O1, O2 to improve visibility.

Referring now to FIG. 3, the output image O1 also includes the one or more obstacles 122. The output image O1 indicates the position of the obstacle 122 in relation to the one or more components 112, 102, 118, 114 (see FIG. 1) of the compactor 100 (see FIG. 1). As depicted in FIG. 3, the obstacle 122 is disposed behind the drum 112, which is visible to the operator due to the transparent depiction of the compactor 100.

Referring now to FIG. 4, the output image O2 also includes the previously compacted region 124. The output image O2 indicates the position of the previously compacted region 124 in relation to the drum 112 of the compactor 100 (see FIG. 1). Further, the output image O2 indicates an alignment or a misalignment between the previously compacted region 124 and the drum 112 based on the output image O2. As depicted in FIG. 4, the drum 112 is misaligned relative to the previously compacted region 124. The output image O2 depicts the misalignment between the drum 112 and the previously compacted region 124, based on which the operator may adjust the compactor so that the drum 112 aligns with the previously compacted region 124.

It may be noted that individual features shown or described for one embodiment may be combined with individual features shown or described for another embodiment. The above-described implementation does not in any way limit the scope of the present disclosure. Therefore, it is to be understood although some features are shown or described to illustrate the use of the present disclosure in the context of functional segments, such features may be omitted from the scope of the present disclosure as defined in the appended claims.

INDUSTRIAL APPLICABILITY

The present disclosure describes the compactor 100 and the system 200 for improving visibility around the compactor 100. The system 200 utilizes the number of imaging devices 202 and the controller 204 to generate the output image O1, O2 for operator perspective that illustrates the one or more components 112, 102, 118, 114 of the compactor 100, such as, the drum 112, the frame 102, and the like as transparent. Specifically, the controller 204 simulates the components 112, 102, 118, 114 as transparent to improve sightlines both around the compactor 100 for presence of the obstacles 122 and/or for visualization of compacted and uncompacted regions at a worksite.

The system 200 is cost-effective and simple to implement. Further, the system 200 can be retrofitted on existing compactors. The system 200 may improve visibility of the operator and may allow the operator to easily identify a location of the obstacle 122 around the compactor 100. Further, the controller 204 may generate the output image O2 that may allow operators to view uncompacted and compacted regions. Specifically, the output image O2 may indicate any misalignment between the drum 112 and the previously compacted region 124 to the operator, which may allow the operator to efficiently perform compaction operations.

Figure 5:
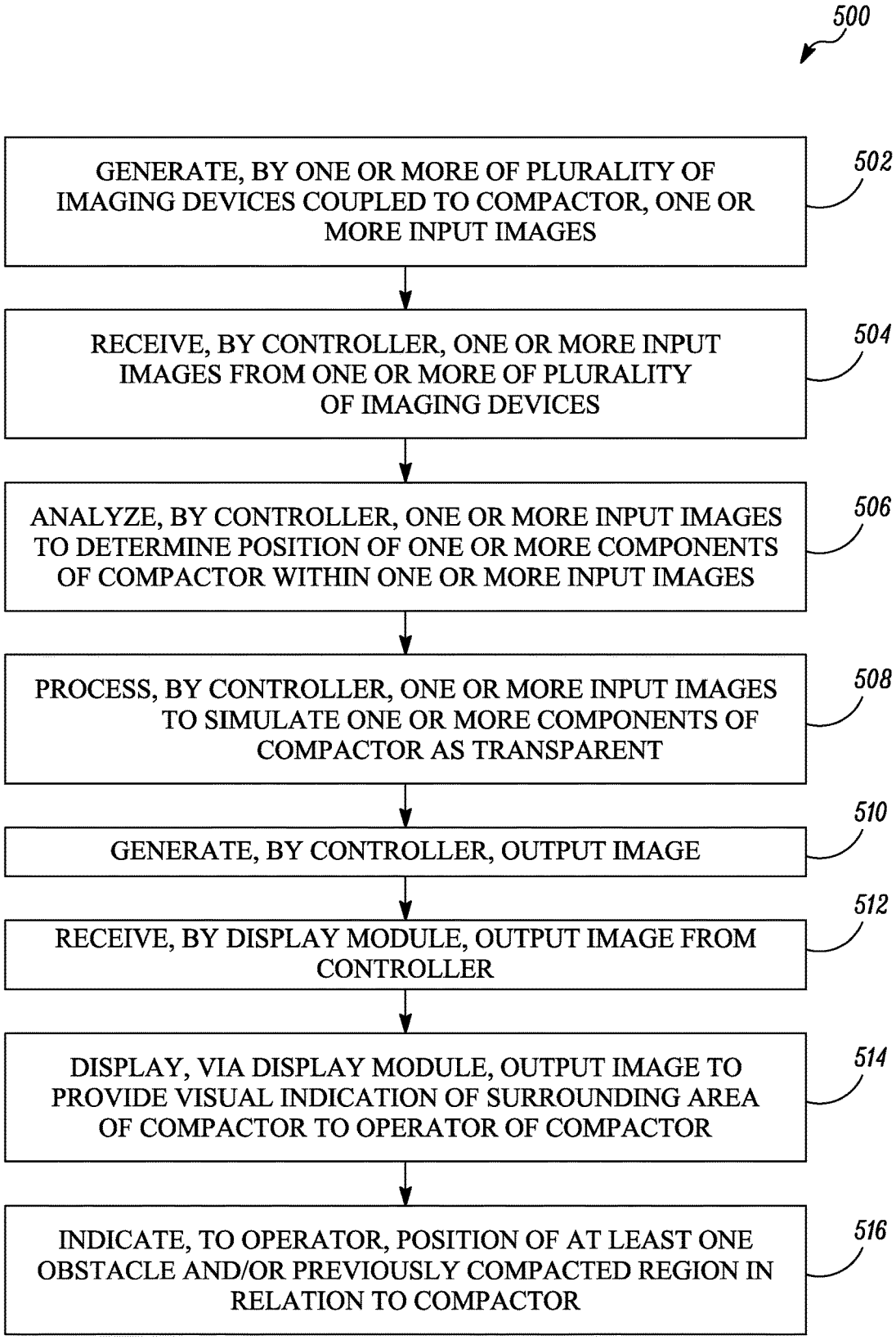
FIG. 5 is a flowchart of a method for improving visibility around a compactor, according to an example of the present disclosure.

Referring to FIG. 5, a flowchart for a method 500 for improving visibility around the compactor 100 is shown.

At step 502, one or more of the number of imaging devices 202 coupled to the compactor 100 generate the one or more input images I1. Each input image I1 includes the surrounding area 120 of the compactor 100 and one or more components 112, 102, 118, 114 of the compactor 100. Further, one or more of the input images I1 generated by one or more of the number of imaging devices 202 includes the one or more obstacles 122 present in the surrounding area 120 of the compactor 100 and/or the previously compacted region 124 compacted by the compactor 100. The one or more components 112, 102, 118, 114 of the compactor 100 includes the drum 112 of the compactor 100, the frame 102 of the compactor 100, portions of the operator cabin 118 of the compactor 100, and/or the one or more wheels 114 of the compactor 100.

At step 504, the controller 204 receives the one or more input images I1 from one or more of the number of imaging devices 202. The number of imaging devices 202 are communicably coupled with the controller 204.

At step 506, the controller 204 analyzes the one or more input images I1 to determine the position of the one or more components 112, 102, 118, 114 of the compactor 100 within the one or more input images I1.

At step 508, the controller 204 processes the one or more input images I1 to simulate the one or more components 112, 102, 118, 114 of the compactor 100 as transparent.

At step 510, the controller 204 generates the output image O1, O2. The output image O1, O2 includes the surrounding area 120 of the compactor 100 and the one or more components 112, 102, 118, 114 of the compactor 100. The one or more components 112, 102, 118, 114 of the compactor 100 are depicted as transparent in the output image O1, O2. The output image O1, O2 further includes the one or more obstacles 122 and/or the previously compacted region 124.

At step 512, the display module 210 receives the output image O1, O2 from the controller 204. The display module 210 is communicably coupled with the controller 204.

At step 514, the display module 210 displays the output image O1, O2 to provide the visual indication of the surrounding area 120 of the compactor 100 to the operator of the compactor 100.

At step 516, the position of the one or more obstacles 122 and/or the previously compacted region 124 in relation to the compactor 100 is indicated to the operator.

In some examples, at the step 516, the position of the previously compacted region 124 in relation to the drum 112 of the compactor 100 is indicated and/or the alignment or the misalignment between the previously compacted region 124 and the drum 112 is indicated based on the output image O2 is indicated.

In some examples, at the step 516, the position of the one or more obstacles 122 in relation to the one or more components 112, 102, 118, 114 of the compactor 100 is indicated.

In some examples, the method 500 further includes a step (not shown) at which the controller 204 receives the number of co-ordinates of the one or more components 112, 102, 118, 114 of the compactor 100 to determine the position of the one or more components 112, 102, 118, 114 of the compactor 100 within the one or more input images I1.

In some example, the method 500 further includes a step (not shown) at which some of the number of imaging devices 202 generate one or more input images I1 of the surrounding area 120 at the front end 104 of the compactor 100. The method 500 further includes a step (not shown) at which some of the number of imaging devices 202 generate one or more input images I1 of the surrounding area 120 at the rear end 106 of the compactor 100. The method 500 further includes a step (not shown) at which some of the number of imaging devices 202 generate one or more input images I1 of the surrounding area 120 at one or more sides 108 of the compactor 100.

Further, the steps 502, 504, 506, 508, 510, 512, 514, 516 of the method 500 may be performed in an order that is different from that depicted in FIG. 5. Furthermore, various steps 502, 504, 506, 508, 510, 512, 514, 516 of the method 500 can be performed together.

While aspects of the present disclosure have been particularly shown and described with reference to the embodiments above, it will be understood by those skilled in the art that various additional embodiments may be contemplated by the modification of the disclosed work machine, systems, and methods without departing from the spirit and scope of the disclosure. Such embodiments should be understood to fall within the scope of the present disclosure as determined based upon the claims and any equivalents thereof.

What is claimed is:

1. A system for improving visibility around a compactor, the system comprising:

a plurality of imaging devices coupled to the compactor, wherein each of the plurality of imaging devices is configured to generate an input image, wherein the input image includes a surrounding area of the compactor and one or more components of the compactor, and wherein one or more of the input images generated by one or more of the plurality of imaging devices includes at least one obstacle present in the surrounding area of the compactor and/or a previously compacted region compacted by the compactor; and a controller communicably coupled with the plurality of imaging devices, wherein the controller is configured to:

receive, from one or more of the plurality of imaging devices, one or more input images;

analyze the one or more input images to determine a position of the one or more components of the compactor within the one or more input images;

process the one or more input images to simulate the one or more components of the compactor as transparent;

generate an output image, wherein the output image includes the surrounding area of the compactor and the one or more components of the compactor, wherein the one or more components of the compactor are depicted as transparent in the output image, and wherein the output image further includes the at least one obstacle and/or the previously compacted region; and a display module configured to receive the output image from the controller, wherein the display module is configured to display the output image thereon to provide a visual indication of the surrounding area of the compactor to an operator of the compactor, and wherein the output image at least indicates, to the operator, a position of the at least one obstacle and/or the previously compacted region in relation to the compactor.

2. The system of claim 1, wherein the one or more components of the compactor includes a drum of the compactor, a frame of the compactor, portions of an operator cabin of the compactor, and/or one or more wheels of the compactor.

3. The system of claim 2, wherein the output image indicates a position of the previously compacted region in relation to the drum of the compactor, and wherein the output image further indicates an alignment or a misalignment between the previously compacted region and the drum based on the output image.

4. The system of claim 1, wherein the controller is further configured to receive a plurality of co-ordinates of the one or more components of the compactor to determine the position of the one or more components of the compactor within the one or more input images.

5. The system of claim 1, wherein a contour of each of the one or more components of the compactor is illustrated as a dotted line on the output image.

6. The system of claim 1, wherein at least some of the plurality of imaging devices are configured to generate one or more input images of the surrounding area at a front end of the compactor, wherein at least some of the plurality of imaging devices are configured to generate one or more input images of the surrounding area at a rear end of the compactor, and wherein at least some of the plurality of imaging devices are configured to generate one or more input images of the surrounding area at one or more sides of the compactor.

7. The system of claim 1, wherein the output image indicates a position of the at least one obstacle in relation to the one or more components of the compactor.

8. A compactor comprising:

a frame;

a drum coupled to the frame; and a system for improving visibility around a compactor, the system comprising:

a plurality of imaging devices coupled to the compactor, wherein each of the plurality of imaging devices is configured to generate an input image, wherein the input image includes a surrounding area of the compactor and one or more components of the compactor, and wherein one or more of the input images generated by one or more of the plurality of imaging devices includes at least one obstacle present in the surrounding area of the compactor and/or a previously compacted region compacted by the compactor; and a controller communicably coupled with the plurality of imaging devices, wherein the controller is configured to:

receive, from one or more of the plurality of imaging devices, one or more input images;

analyze the one or more input images to determine a position of the one or more components of the compactor within the one or more input images;

process the one or more input images to simulate the one or more components of the compactor as transparent;

generate an output image, wherein the output image includes the surrounding area of the compactor and the one or more components of the compactor, wherein the one or more components of the compactor are depicted as transparent in the output image, and wherein the output image further includes the at least one obstacle and/or the previously compacted region; and a display module configured to receive the output image from the controller, wherein the display module is configured to display the output image thereon to provide a visual indication of the surrounding area of the compactor to an operator of the compactor, and wherein the output image at least indicates, to the operator, a position of the at least one obstacle and/or the previously compacted region in relation to the compactor.

9. The compactor of claim 8, wherein the one or more components of the compactor includes the drum of the compactor, the frame of the compactor, portions of an operator cabin of the compactor, and/or one or more wheels of the compactor.

10. The compactor of claim 9, wherein the output image indicates a position of the previously compacted region in relation to the drum of the compactor, and wherein the output image further indicates an alignment or a misalignment between the previously compacted region and the drum based on the output image.

11. The compactor of claim 8, wherein the controller is further configured to receive a plurality of co-ordinates of the one or more components of the compactor to determine the position of the one or more components of the compactor within the one or more input images.

12. The compactor of claim 8, wherein a contour of each of the one or more components of the compactor is illustrated as a dotted line on the output image.

13. The compactor of claim 8, wherein at least some of the plurality of imaging devices are configured to generate one or more input images of the surrounding area at a front end of the compactor, wherein at least some of the plurality of imaging devices are configured to generate one or more input images of the surrounding area at a rear end of the compactor, and wherein at least some of the plurality of imaging devices are configured to generate one or more input images of the surrounding area at one or more sides of the compactor.

14. The compactor of claim 8, wherein the output image indicates a position of the at least one obstacle in relation to the one or more components of the compactor.

15. A method for improving visibility around a compactor, the method comprising:

generating, by one or more of a plurality of imaging devices coupled to the compactor, one or more input images, wherein each input image includes a surrounding area of the compactor and one or more components of the compactor, and wherein one or more of the input images generated by one or more of the plurality of imaging devices includes at least one obstacle present in the surrounding area of the compactor and/or a previously compacted region compacted by the compactor;

receiving, by a controller, one or more input images from one or more of the plurality of imaging devices, wherein the plurality of imaging devices are communicably coupled with the controller;

analyzing, by the controller, the one or more input images to determine a position of one or more components of the compactor within the one or more input images;

processing, by the controller, the one or more input images to simulate the one or more components of the compactor as transparent;

generating, by the controller, an output image, wherein the output image includes the surrounding area of the compactor and the one or more components of the compactor, wherein the one or more components of the compactor are depicted as transparent in the output image, and wherein the output image further includes the at least one obstacle and/or the previously compacted region;

receiving, by a display module, the output image from the controller, wherein the display module is communicably coupled with the controller; and displaying, via the display module, the output image to provide a visual indication of the surrounding area of the compactor to an operator of the compactor; and indicating, to the operator, a position of the at least one obstacle and/or the previously compacted region in relation to the compactor.

16. The method of claim 15, wherein the one or more components of the compactor includes a drum of the compactor, a frame of the compactor, portions of an operator cabin of the compactor, and/or one or more wheels of the compactor.

17. The method of claim 16, wherein the step of indicating, to the operator, the position of the at least one obstacle and/or the previously compacted region in relation to the compactor further includes:

indicating a position of the previously compacted region in relation to the drum of the compactor; and/or indicating an alignment or a misalignment between the previously compacted region and the drum based on the output image.

18. The method of claim 15, wherein the step of indicating, to the operator, the position of the at least one obstacle and/or the previously compacted region in relation to the compactor further includes indicating a position of the at least one obstacle in relation to the one or more components of the compactor.

19. The method of claim 15 further comprising receiving, by the controller, a plurality of co-ordinates of the one or more components of the compactor to determine the position of the one or more components of the compactor within the one or more input images.

20. The method of claim 15 further comprising:

generating, by some of the plurality of imaging devices, one or more input images of the surrounding area at a front end of the compactor;

generating, by some of the plurality of imaging devices, one or more input images of the surrounding area at a rear end of the compactor; and generating, by some of the plurality of imaging devices, one or more input images of the surrounding area at one or more sides of the compactor.

* * * * *